US010487524B2

(12) United States Patent
Kadlecova et al.

(10) Patent No.: US 10,487,524 B2
(45) Date of Patent: Nov. 26, 2019

(54) METHOD FOR MANIPULATION WITH A THERMO-INSULATING SPA OR SWIM SPA COVER AND A DEVICE FOR PERFORMING THE METHOD

(71) Applicant: USSPA, s.r.o., Dolni Obrouc (CZ)

(72) Inventors: Katerina Kadlecova, Dolni Obrouc (CZ); Jan Kadlec, Dolni Obrouc (CZ)

(73) Assignee: USSPA, s.r.o., Dolni Obrouc (CZ)

( * ) Notice: Subject to any disclaimer, the term of this patent is extended or adjusted under 35 U.S.C. 154(b) by 211 days.

(21) Appl. No.: 15/624,858

(22) Filed: Jun. 16, 2017

(65) Prior Publication Data

US 2018/0073263 A1 Mar. 15, 2018

(30) Foreign Application Priority Data

Sep. 14, 2016 (CZ) ..... PV 2016-564

(51) Int. Cl.
*E04H 4/08* (2006.01)
*B63B 19/19* (2006.01)
*B63B 29/18* (2006.01)

(52) U.S. Cl.
CPC ..... *E04H 4/084* (2013.01); *B63B 19/19* (2013.01); *B63B 29/18* (2013.01)

(58) Field of Classification Search
CPC .. E04H 4/06; E04H 4/08; E04H 4/082; E04H 4/084; E04H 4/086; E04H 4/088; B63B 19/19; B63B 29/18
USPC ..... 4/498–500, 580, 661
See application file for complete search history.

(56) References Cited

U.S. PATENT DOCUMENTS 3,895,400 A * 7/1975 Kelcey ..... E04B 1/34357 4/287
5,048,153 A 9/1991 Wall et al.
5,689,841 A 11/1997 Black et al.
5,947,178 A * 9/1999 Patten ..... E04H 4/088 160/193

(Continued)

FOREIGN PATENT DOCUMENTS

DE 10 2008 032158 2/2009
FR 2 966 857 5/2012

(Continued)

OTHER PUBLICATIONS

Czech Republic Search Report, dated Jun. 9, 2017.

*Primary Examiner* — Beth A Stephan
(74) *Attorney, Agent, or Firm* — Dority & Manning, P.A.

(57) ABSTRACT

A system and method are used for manipulation of a spa cover between a closed position, an open position, and a parking position, whereby the cover has a first carrier segment coupled to an actuator and a second carried segment rotatably connected to the first carrier segment. An axis of rotation of the first carrier segment is first raised from a resting position to an upper position, thereby raising the first carrier segment and creating a gap between the first carrier segment and an edge of the spa vessel. The first carrier segment is then rotated about the axis of rotation, which is situated outside of a ground plan of the spa. The second carried segment is pulled towards the first carrier segment as the first carrier segment is rotated. The first carrier segment is rotated to the open position wherein the segments are in a vertical position with their respective lower bearing surfaces facing each other.

13 Claims, 10 Drawing Sheets

(56) References Cited

U.S. PATENT DOCUMENTS

| | | | | |
|---|---|---|---|---|
| 5,974,600 | A | 11/1999 | Pucci et al. | |
| 6,000,071 | A | 12/1999 | Fettes | |
| 6,158,063 | A * | 12/2000 | Tudor | E04H 4/084 16/280 |
| 6,393,610 | B1 | 5/2002 | Tedrick | |
| 6,795,984 | B1 | 9/2004 | Brady | |
| 7,155,756 | B1 | 1/2007 | Helder | |
| 7,290,297 | B2 * | 11/2007 | Cunerty | A47K 3/001 248/286.1 |
| 8,516,626 | B2 * | 8/2013 | Gardenier | A61H 33/02 4/498 |
| 8,726,429 | B1 * | 5/2014 | Midkiff | E04H 4/084 4/498 |
| 2007/0209104 | A1 | 9/2007 | Buzzetti et al. | |
| 2009/0049595 | A1 * | 2/2009 | Muller | E04H 4/084 4/500 |
| 2010/0313352 | A1 * | 12/2010 | Sloss | E04H 4/084 4/498 |
| 2011/0048654 | A1 * | 3/2011 | Kolar | E04H 4/084 160/188 |
| 2015/0204095 | A1 * | 7/2015 | Tournas | E04H 4/084 4/493 |
| 2016/0053505 | A1 * | 2/2016 | Dose | E04H 4/084 4/498 |
| 2017/0081869 | A1 * | 3/2017 | Huber | E04H 4/08 160/188 |
| 2017/0121992 | A1 * | 5/2017 | Spicer | E04H 4/084 |

FOREIGN PATENT DOCUMENTS

| | | | | |
|---|---|---|---|---|
| FR | 2966858 | A1 * | 5/2012 | E04H 4/084 |
| WO | WO 2007/058953 | A2 | 5/2007 | |
| WO | WO 2009/129756 | | 10/2009 | |

* cited by examiner

METHOD FOR MANIPULATION WITH A THERMO-INSULATING SPA OR SWIM SPA COVER AND A DEVICE FOR PERFORMING THE METHOD

TECHNICAL FIELD

The invention relates to a method for manipulation of a thermo-insulating spa or swim spa cover between its closed position, open position, and parking position. The thermo-insulating cover has a carrying thermo-insulating segment, coupled to an actuator, and a carried thermo-insulating segment, which is rotatably connected to the carrier segment, whereby the thermo-insulating cover is, during opening or closing rotated by the carrier segment (which carries the carried segment). In the open position, both thermo-insulating segments are in a vertical position facing each other with their bearing surfaces, whereby during opening and closing, the carrier segment rotates about an axis that lies outside the ground plan of the spa or swim spa.

The invention also relates to a device for manipulation of a thermo-insulating spa or swim spa cover, which enables its automatic opening, closing, and parking, and which comprises a rotational device of a carrier segment for rotation of the carrier segment between a closed position and an open position, and a device for vertical manipulation of the cover between its open position and parking position.

BACKGROUND ART

Nowadays, there are numerous types of massage pools, also known as whirlpools or spas, and swimming massage pools or swim spas, which are massage pools of larger dimensions suitable especially for active swimming. Spas or swim spas are used for relaxation and rehabilitation and they are also designed to complement houses and villas, both in the interior and the exterior. Spas and swim spas range in ground plan size from approximately 1×2 m for a spa up to 3×6 m for a swim spa. The structure of spas and swim spas is designed to keep the water clean and warm for a long time. This is achieved by an insulated structure of a shell and a thermo-insulating cover, which prevents leakage of moisture and heat from the spa or swim spa, thus reducing the operation costs. Moreover, the cover prevents injuries of young children and pets, protects the massage pool from contamination with impurities and dust, and prevents penetration of solar radiation that causes microorganisms to multiply in the water. Even though thermo-insulating covers are made from a lightweight material, their weight is still relatively great with respect to their dimensions, which makes these covers difficult to handle. The most commonly used thermo-insulating covers consist of two thermo-insulating segments, which are rotatably connected to each other and are manually moved from a closed position to an open position and vice versa. In the closed position, at the beginning of the handling operation, one thermo-insulating segment is folded over the other so they touch each other with their originally upper sides, and subsequently they are removed, whereby two persons are usually necessary for the removal. Another disadvantage of manual removal of the thermo-insulating cover is a problem of storing the thermo-insulating cover while the spa or swim spa is used.

Therefore, devices for manipulation of the segments of thermo-insulating covers between theft closed position and open position have been developed, including both manually controlled mechanical devices and semi-automatic devices, as well as automatic devices reacting only to commands from an operator.

U.S. Pat. No. 5,689,841, for example, discloses a mechanism for lifting a two-segment thermo-insulating cover from a spa or swim spa by means of a device by which the first thermo-insulating segment is rotatably connected to the spa. When moving the thermo-insulating cover to a storage position, at first the second thermo-insulating segment is raised and folded back over the first thermo-insulating segment, and so both segments touch each other with their originally upper sides. After that the first thermo-insulating segment is raised to a vertical position along with the second thermo-insulating segment by means of a lifting device and, as a result, the spa is uncovered.

Similar mechanisms have been described, for example, in documents U.S. Pat. No. 6,795,984, US2007/0209104 and U.S. Pat. No. 6,000,071. Nevertheless, in all these solutions, during the time when the spa is used, the thermo-insulating cover remains on the edge of the spa in a vertical, i.e. storage position, in which it impedes access to the massage spa from one of its sides and restricts the view. Storing the thermo-insulating cover in another position while the spa is used is partially solved, for example, by solutions disclosed in U.S. Pat. Nos. 7,155,756, 5,048,153, 5,974,600 or WO2007/058953, in which the thermo-insulating cover, after being raised from the upper circumference of the spa, is lowered or dropped to a space outside the ground plan of the massage pool, for example, beside the back wall of the spa. However, similarly as in the case of the above-mentioned solutions, it is first necessary to fold the second thermo-insulating segment over the first thermo-insulating segment so that they touch each other with their originally upper sides, which is in most cases performed manually. Still, there is a problem with the difficult manipulation of the thermo-insulating cover, the weight of which is considerably high.

U.S. Pat. No. 7,155,756 discloses a mechanism for automatic folding of a second thermo-insulating segment over a first thermo-insulating segment to a position described in the above-mentioned solutions. This mechanism is rather complicated and puts great demands on the construction of the entire lifting device, which also increases its acquisition and operating costs. Moreover, the aesthetic impression is significantly worsened. All the devices for manipulation of thermo-insulating covers according to the background art must be dimensioned for lifting the entire weight of both thermo-insulating segments or for rotating the entire weight of both thermo-insulating segments, which means that these devices are bulky and their cost increases.

In all these cases of manipulation, it is always the bottom side of the cover that remains visible after the cover is lifted and folded. The bottom side is always degraded in terms of appearance and surface, since it is exposed to the aggressive wet environment and chemical substances in the water and vapors under the cover when closed. The bottom side of these covers may be non-hygienic for touch, as well as for breathing.

CZ PV 2008-243 (WO 2009/129756) discloses a method of manipulation of a thermo-insulating cover of a spa or a swim spa between its covering position and opened position. The cover comprises a pair of thermo-insulating segments consisting of a carrier thermo-insulating segment and a carried thermo-insulating segment, which are rotatably connected to each other and in the covering position are lying with their bottom surfaces on the circumference of the spa or swim spa. The carrier thermo-insulating segment is rotatably mounted on the spa or swim spa. During the phase of opening, the carrier thermo-insulating segment is rotated and its front end is raised, carrying the carried segment. After the carrier segment reaches a vertical position, the carried segment is drawn by force to the carrier segment, until both segments touch each other with their bottom surfaces. In the opened position, therefore, the original upper sides of the segments are on the outside side of the raised pair of segments, which is advantageous compared to the previous solutions. Although the method allows the thermo-insulating spa or swim spa cover to be opened and closed reliably, the operation of opening as well as closing is performed in two steps, each step requiring a separate device arranged on each side of the cover—two devices for the rotation of the carrier segment and two devices for bringing the carried segment closer and removing it, which increases costs and reduces reliability. Both segments can be lowered together to a storage position in a storage space, but two additional means for lowering and extending the thermo-insulating segments are needed.

SUMMARY OF THE INVENTION

It is therefore a goal of the invention to simplify the method for manipulation of a spa or swim spa thermo-insulating cover and, in particular, to simplify the device for the cover-handling operations, thereby increasing their reliability and reducing manufacturing and operating costs of the device for performing the method. Additional objects and advantages of the invention will be set forth in part in the following description, or may be obvious from the description, or may be learned through practice of the invention.

The goal of the invention is achieved by a method according to the invention, whose principle consists in that prior to initiating rotation of the carrier thermo-insulating segment for opening, its axis of rotation is raised above its resting position to its upper position, thereby raising the rear face of the carrier segment and creating a gap between the bearing surface of the carrier segment and the edge of the spa vessel, whereupon the rotation of the carrier segment to a vertical position is initiated. The inner surface of the spa or swim spa is connected by means of the gap to the surrounding environment and pressures are balanced, and so it is only the force derived by the weight of both segments of the thermo-insulating cover and any resistors that is overcome when rotating by means of the carrier segment. This reduces performance requirements of the rotational means.

After reaching the vertical position, both thermo-insulating segments along with the rotational device are lowered to their parking position.

To close the cover, both thermo-insulating segments are displaced from the parking position to the opening/closing position in which both segments maintain the vertical position and the axis of rotation of the carrier segment is above the level of its resting position, whereupon the carrier segment rotates until the front portion thereof abuts the edge of the spa vessel, after which the axis of rotation of the carrier segment is moved to its resting position and both thermo-insulating segments are pressed against/put on the edge of the spa/swim spa.

The axis of rotation of the rotational device and the carrier segment is, during both opening and closing, in its upper position above its resting position, wherein the displacement of the axis of rotation of the rotation device and of the carrier segment between its resting position and the upper position is carried out in the vertical direction by a device for vertical manipulation with the carrier segment and the rotational device of the carrier segment. Using the method according to the invention has greatly improved the reliability of manipulation of the spa cover.

The principle of the spa or swim spa cover manipulation device is that the carrier segment is fixedly attached to a rotational device which, in order to control its vertical position, is connected to a device for vertical manipulation of the cover and the rotational device, whereby it is vertically displaceable, together with the carrier segment, between its resting position, upper position, and parking position. The advantage of the device is its simple construction, reduced production costs, as well as lower maintenance costs due to improved reliability.

According to one variant of embodiment of the rotational device of the carrier segment, the device comprises a pair of rotary actuators mounted on the devices for vertical manipulation, which are coupled to struts of the frame of a control device. The rotational device and the device for vertical manipulation are coupled to a control unit that ensures the synchronization of pairs of rotary actuators and pairs of actuators of the devices for vertical manipulation, synchronizing both the initiation of their movement and the speed of this movement.

In an alternative embodiment, the rotational devices are hinged on flexible support members that are guided from the rotational devices upwards over carrying pulleys rotatably mounted on the frame of the control device above the upper position of the rotational devices and are further guided to a lifting and lowering actuator that is also mounted on the frame of the control device.

According to another alternative, the rotational device of the carrier segment is mounted vertically on a movable beam of the device for vertical manipulation, whereby on the movable beam is mounted a swinging coulisse, which is coupled to a rotary actuator. On the swinging coulisse are rotatably mounted rods coupled to angular levers arranged at the ends of the movable beam. Each of the angular levers is coupled to a respective rotary lever, also swingingly mounted on the movable beam on which a supporting plate is formed, which is fixedly attached to the rear face of the carrier segment.

In a preferred embodiment, the movable beam is hinged at two points at the ends of the flexible support member, which is guided from the point of the hinge upwards over the carrying pulleys rotatably mounted on the frame of the control unit above the upper position of the movable beam and is further guided to a lifting and lowering actuator, which is also mounted on frame of the control device.

The lifting and lowering actuator may be formed by a winding device rotatable in either direction, or by a linear actuator, whereby at the end of its movable portion is arranged a tightening member, to which is/are coupled a flexible support member/members.

In an embodiment with the movable beam being hinged, it is advantageous for the flexible support member to have two branches, whereby the first branch is guided from the hinge on the movable beam over the first carrying pulley to a tightening member, which is wrapped by it, after which the first branch continues as a second branch, which is guided from the tightening member over an auxiliary pulley to a second carrying pulley, which is wrapped by it. The second branch is terminated in the hinge on the movable beam, whereby the tightening member is mounted on a movable portion of the linear actuator, whose fixed portion is mounted in the frame of the control device, whereby the linear actuator constitutes a lifting and lowering actuator for vertical manipulation.

In a preferred embodiment, the linear actuator is arranged in one of the bottom corners of the frame of the control device.

DESCRIPTION OF DRAWINGS

Exemplary embodiments in different phases of operation are schematically represented in the drawings, wherein.

DETAILED DESCRIPTION

Figure 1:
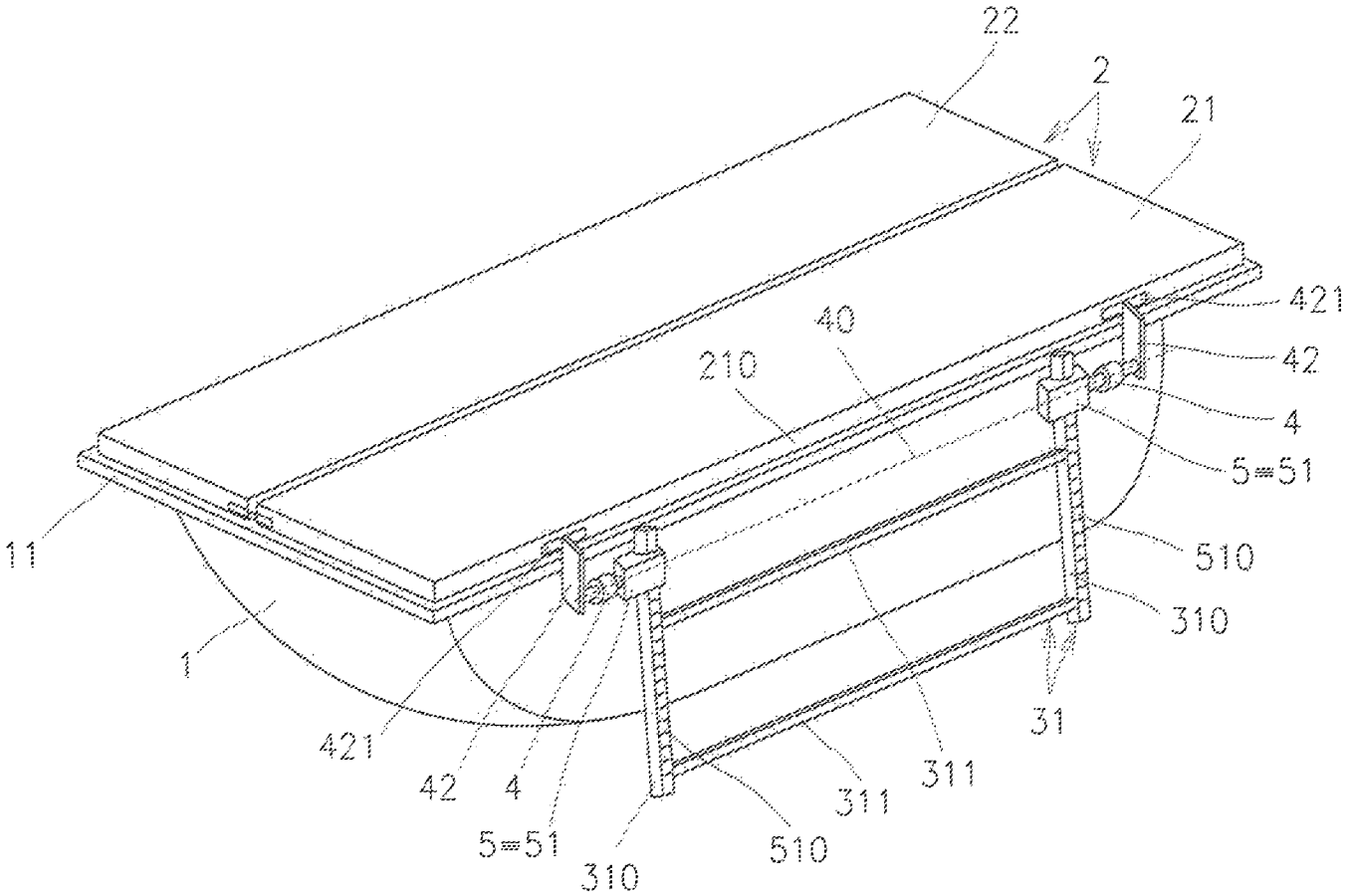
FIG. 1 shows a view of a device for manipulation with a spa cover with the first variant of a rotational device for vertical manipulation in the closed position.
Figure 2:
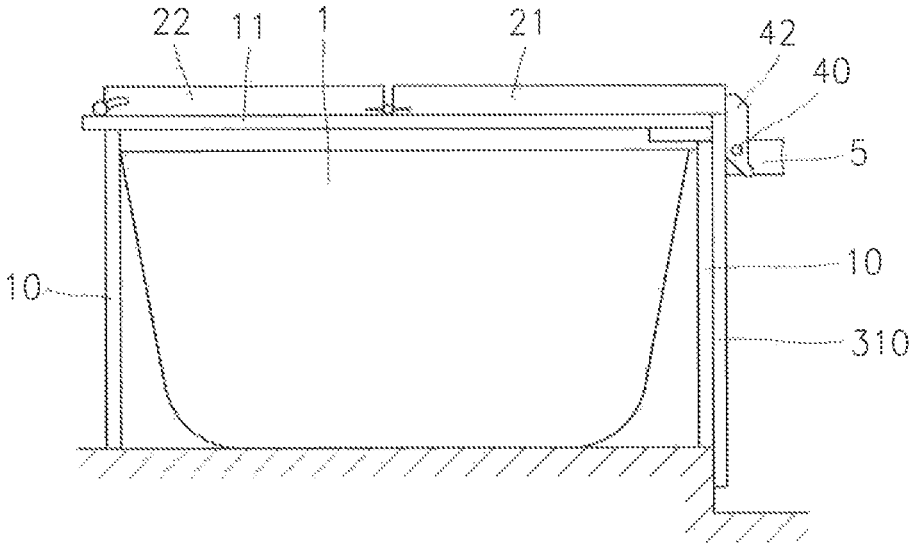
FIG. 2 is a side view of the device according to FIG. 1 in the closed position.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

A spa or swim spa, hereinafter referred to as a spa, comprises a suitably shaped vessel 1, which is thermally insulated and is arranged in a support structure 10 schematically represented in FIGS. 2, 4-7 and in the arrangement above ground level the spa vessel is provided with a shell, the so-called cabinet (not shown). In another embodiment, the spa vessel 1 is mounted in a pit, whereby its edge 11, formed in the upper part of the spa vessel 1, rests on the edges of the pit, and its bottom part lies at the bottom of the pit. A thermo-insulating cover 2 is mounted on the edge 11, consisting of two thermo-insulating segments 21, 22, which in a closed position abut with their bottom surfaces against the edge 11 of the spa vessel 1. The thermo-insulating segments 21, 22 are rotatably connected (hinged) to each other in a known manner, whereby the connection allows their rotation towards each other with their bottom surfaces. One of the thermo-insulating segments is a carrier segment 21 and the other is a carried segment 22, which is carried due to being connected to the carrier segment 21. The carrier segment 21 is coupled to a control device of the spa cover 2, which is mounted on a special frame 31, connected to a support structure 10 of the spa. The control device comprises a rotational device 4 which is coupled to a device 5 for vertical manipulation at the same time/together with the rotational device 4 and the cover 2. Both the control device and the frame 31 are arranged outside the ground plan of the spa vessel 1 defined by the edge 11, which means that also the axis 40 of rotation of the rotational device 4, which is at the same time the axis 40 of rotation of the carrier segment 21, is situated outside the ground plan of the spa vessel 1. The frame 31 of the control device contains at least two struts 310 and at least two crossbeams 311.

Figure 3:
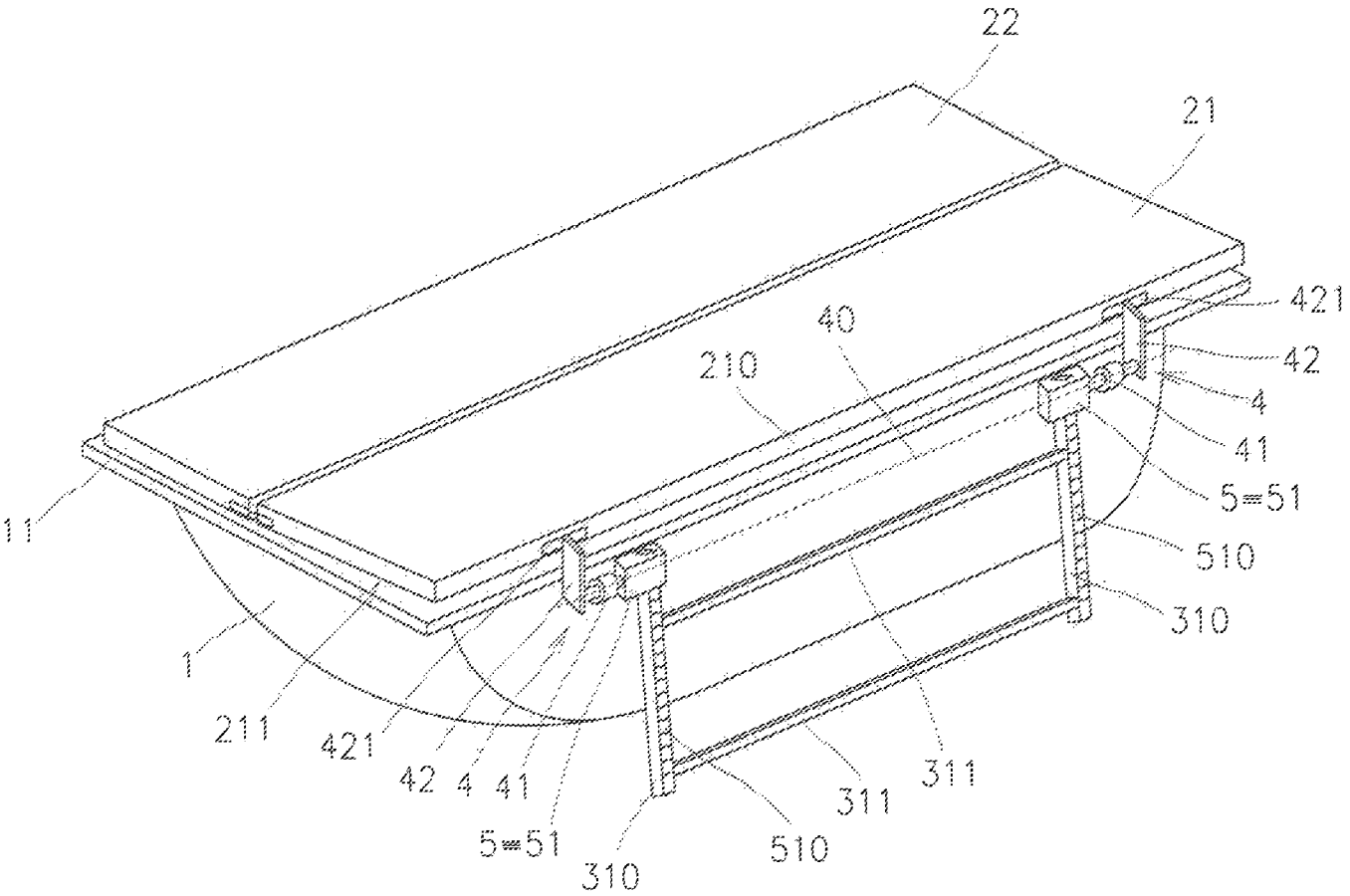
FIG. 3 is view of the device according to FIG. 1 with a raised rear portion of the cover.

In an embodiment according to FIGS. 1 and 3, the rotational device 4 of the carrier segment 21 comprises a pair of rotary actuators 41, mounted on the housings 51 of the device 5 for vertical manipulation, which are adjustably mounted on both side struts 310 of the frame 31. In an unillustrated embodiment, the rotational devices 4 are mounted on other suitable parts of the device 5 for vertical manipulation. The rotary actuators 41 are in a known manner mutually synchronized and connected to a known unillustrated control unit, and so after receiving a command of the control unit they are capable of rotating at the same angular speed and at the same time. The rotary actuator 41 is directly or via suitable gear members (in FIGS. 1 and 3 unillustrated) connected to a rotary lever 42, which is terminated by a supporting plate 421. The supporting plate 421 is fixedly attached to the rear face 210 of the carrier segment 21.

In an embodiment shown in FIGS. 1 to 7, each device 5 for vertical manipulation comprises a lifting actuator consisting of a suitable linear actuator, such as a rack gearing, whose rack 510 is in the illustrated embodiment embedded in the struts 310 of the frame 31 and a motor with a pinion, whose teeth engage with the teeth of a respective rack 510. The motor and the pinion are not illustrated and are mounted in a known manner in the housings 51 of the devices 5 for vertical manipulation, whereby the two motors are in a known manner mutually synchronized and connected to the known control unit, which means that upon the control unit command they are capable of rotating at the same angular speed and at the same time.

In the closed position, both segments 21, 22 abut the thermo-insulating cover 2 against the edge 11 of the spa vessel 1 along its entire circumference and, consequently, the inner space of the spa is insulated from the outer space. At the beginning of opening the thermo-insulating cover 2 from the closed position, at first the axis 40 of rotation of the carrier segment 21 raises from its resting position to its upper position, thereby raising the rear face 210 of the carrier segment 21 along with the rotational device 4 of the carrier segment 21. Consequently, the rear portion of the bearing surface 211 of the carrier segment 21 gets out of contact with the edge 11 of the spa vessel 1 and the inner space and the surrounding environment are interconnected through the gap which has been formed, thereby reducing the force required to initiate the rotation of the carrier segment 21, since it is no longer necessary to overcome the vacuum in the closed space between the bearing surface 211 of the carrier segment 21 and the edge 11 of the spa vessel 1.

Figure 4:
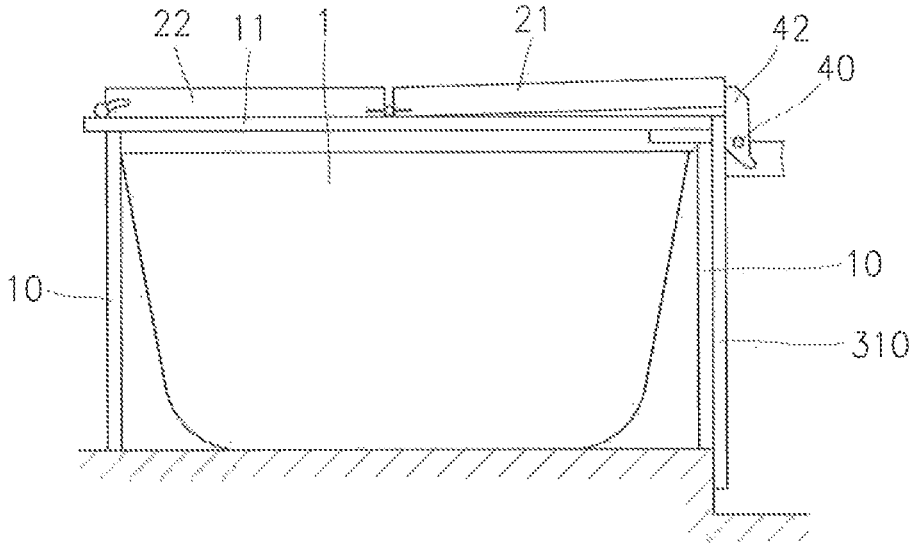
FIG. 4 is a side view of the device in the position according to FIG. 3.

For this purpose, upon a command from an unillustrated control unit, both devices 5 for vertical manipulation simultaneously move from their resting position in which the thermo-insulating cover 2 is closed, to their upper position, carrying both rotational devices 4 and at the same time, via the rotary lever 42 carrying the rear portion of the carrier segment 21, until a gap is created between the carrier segment 21 and the edge 11, as is shown in FIGS. 3 and 4. The front portion of the carrier segment 21 along with the carried segment 22 maintain on the edge 11 of the spa vessel 1. At the same time, the axis 40 of rotation of the carrier segment 21 and of the rotational device 4 has been displaced to its upper position.

Figure 5:
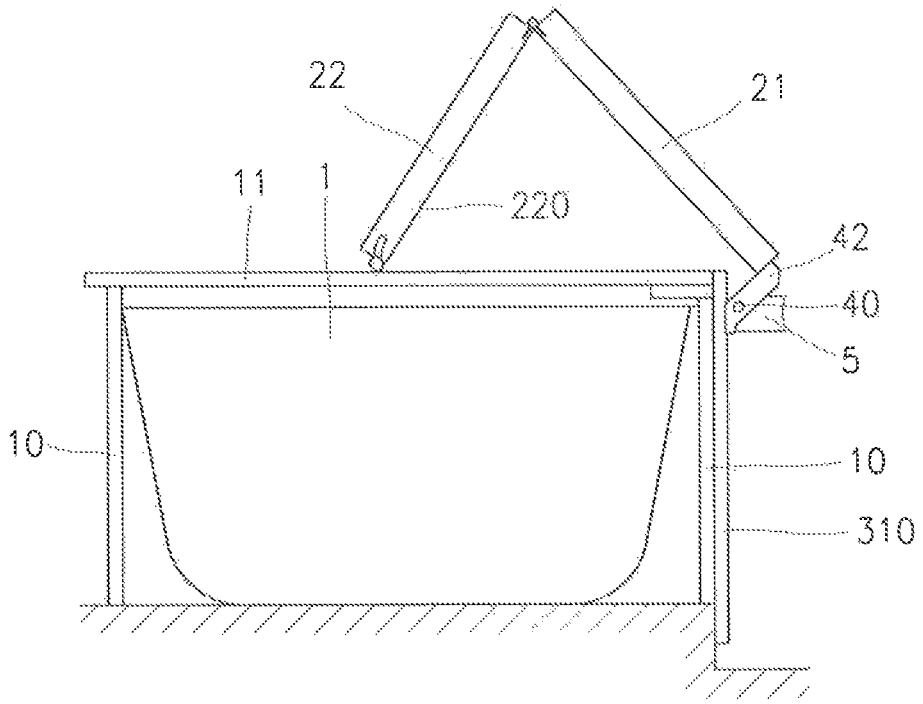
FIG. 5 is a side view of the device after starting rotation of the carrier segment in a partially open position.

In the second step of the opening of the spa thermo-insulating cover 2 the rotational device 4 of the carrier segment 21 starts to operate and begins to rotate the carrier segment 21 away from the edge 11 of the spa vessel 1 about the axis 40. At the same time, the front portion of the carrier segment 21 is raised and carries the rear portion of the carried segment 22, whose front portion provided with wheels or gliders is in contact with the edge 11 of the spa vessel 1 for a certain period of time and moves on it, as shown in FIG. 5.

As the rotational movement of the rotational device 4 and of the carrier segment 21 continues, the front portion of the carried segment 22 moves away from the edge 11 of the spa vessel 1 due to being shorter in comparison with the carrier segment 21.

Figure 6:
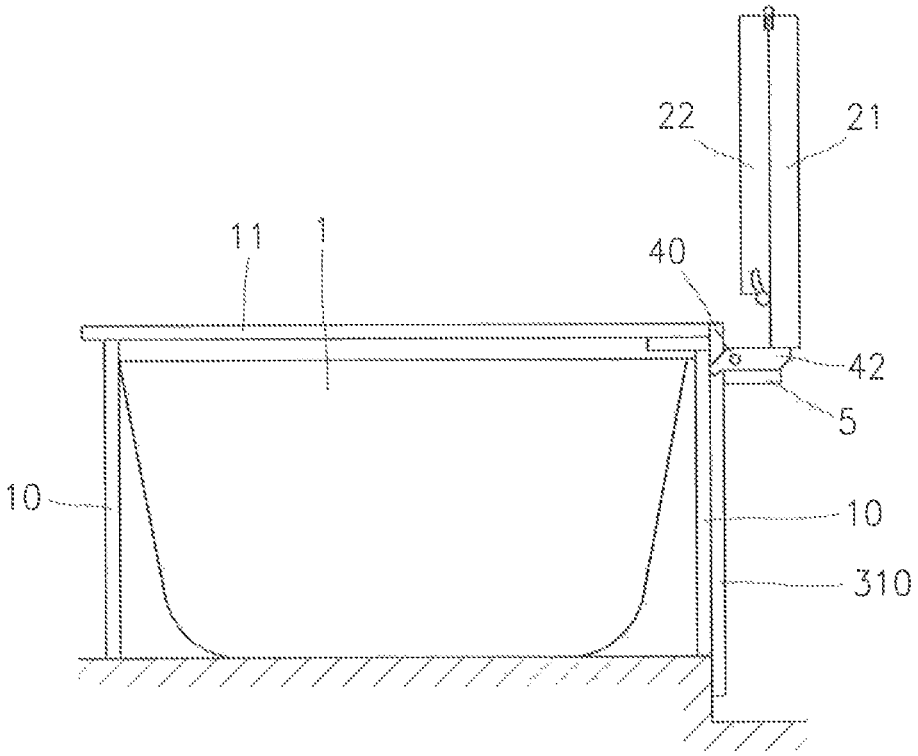
FIG. 6 is a side view of the device after the rotation of the carrier segment is completed, both the carrier segment and the carried segment being in the vertical position.

The rotational device 4 will terminate its activity as soon as the carrier segment 21 reaches its vertical position, whereby the carried segment 22 also settles at the same position, as is shown in FIG. 6, which means that both segments 21, 22 are in their open position.

Figure 7:
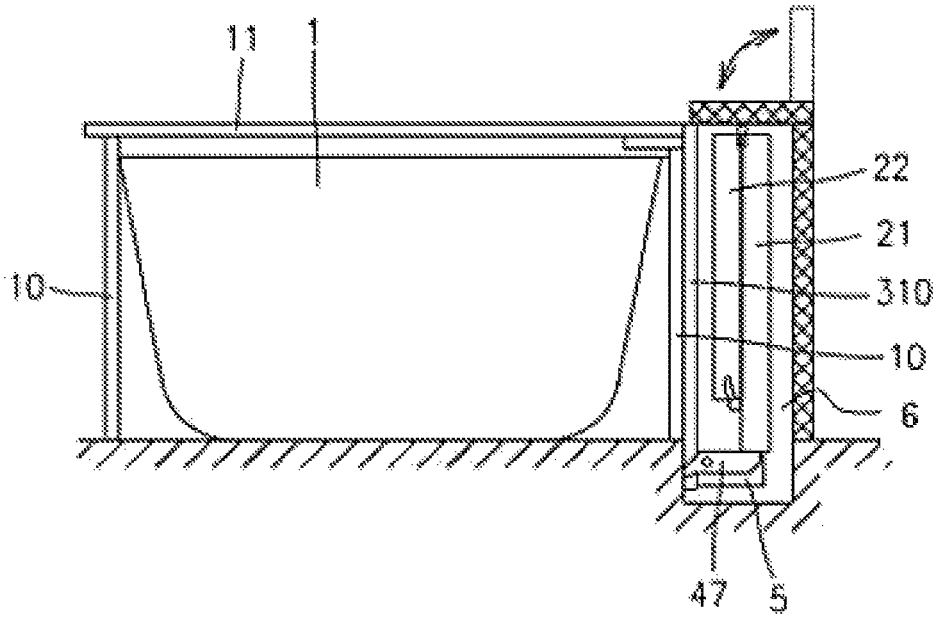
FIG. 7 is a side view of the device with a cover in the parking position.

Subsequently, both devices 5 for vertical manipulation of the thermo-insulating cover 2 and the rotational device 4 are actuated simultaneously and start lowering the rotational device 4 and the cover 2 in the vertical position, both being lowered at the same time and at the same speed to their parking position in the parking space 6, which is formed next to the spa vessel 1, as shown in FIG. 7. The parking space 6 may be designed in a different manner according to the spa design, for example by enlarging the spa cabinet, or by increasing the pit in which the spa is installed, or in another suitable manner.

When closing the thermo-insulating cover 2, the procedure is opposite.

First, the device 5 for vertical manipulation with the thermo-insulating cover 2 and with the rotational device 4 lift the rotational device 4 along with the cover 2 from the parking position to the upper position, in which the device 5 for vertical manipulation stops. Subsequently, the rotational device 4 is initiated and starts to rotate the carried segment 21 towards the edge 11 of the spa vessel 1. The carried segment 22, which is shorter than the carrier segment 21, in the initial phase of the rotation of the carrier segment 21 assumes the vertical position, which means it hangs freely on the carrier segment until the moment when the wheels or gliders of the carried segment 22 abut the edge 11. As the carrier segment 21 continues to rotate, the carried segment 22 starts to open away from the carrier segment 21, until its bearing surface 220 comes into contact with the edge 11 of the spa vessel 1. Simultaneously, the front portion of the carrier segment 21 abuts the edge 11 of the spa vessel 1 as well. Both the rotational device 4 and the device 5 for vertical manipulation with the thermo-insulating cover 2 and the rotational device 4 remain in their upper position during the rotation of the carrier segment 21, and so after the rotation of the carrier segment 21 is completed, a gap is formed between the rear portion of its bearing surface 211 and the edge 11 of the spa vessel 1. In the last step of closing the thermo-insulating cover 2 the device 5 for vertical manipulation is lowered to its resting position and the rear portion of the bearing surface 211 of the carrier segment 21 abuts the edge 11 of the spa vessel 1.

The actual design of the rotational device 4 of the carrier segment 21 and/or the device 5 for vertical manipulation with the cover 2 and the rotational device 4 may vary and may employ both rotary actuators and linear actuators.

Figure 8:
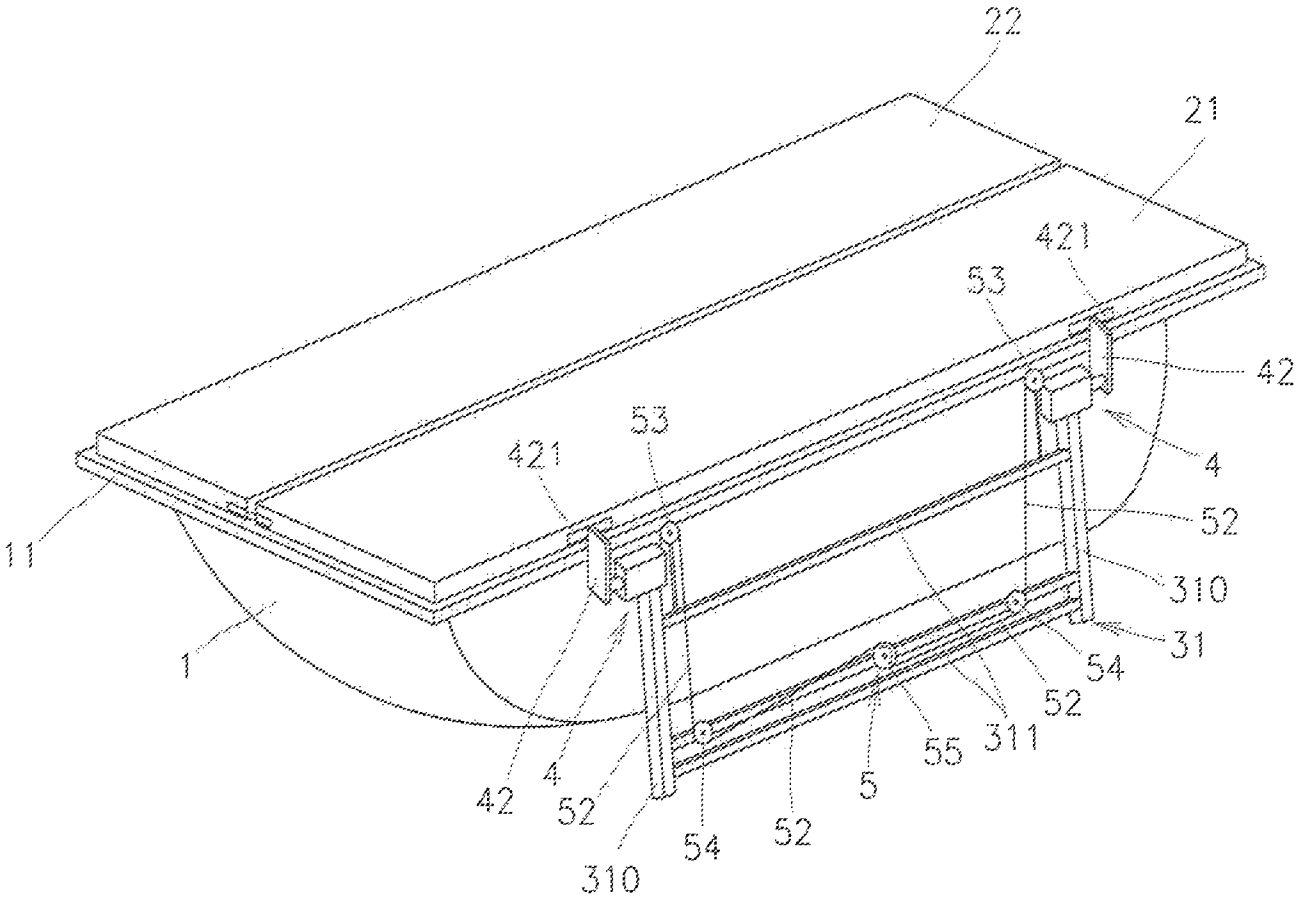
FIG. 8 shows a view of the device for manipulation with a spa cover having an alternative variant of the device for vertical manipulation.

One of the possible variants of the device 5 for vertical manipulation is shown in FIG. 8, which schematically represents the rotational device 4 of the carrier segment 21 hinged on flexible support members 52, which are guided upwards from the respective rotational device 4 over the carrying pulleys 53 which are rotatably mounted on the frame 31 of the control device above the upper position of the rotational devices 4. The flexible support members 52 are guided over the guide pulleys 54, which are rotatably mounted on the frame 31 towards the lifting and lowering actuator, which is also mounted on the frame 31. In the illustrated embodiment, the lifting and lowering actuator comprises a winding device 55, to which are attached both the support members 52 and which is composed of a suitable electrical winch, which is rotatable in either direction. The winding device 55 is coupled to a known unillustrated motor and the control unit, whereby in the resting position it can rotate in either direction.

In an unillustrated embodiment, the lifting and lowering actuator is linear and at the end of its movable portion is arranged a tightening member, to which support members 52 are coupled. In a preferred embodiment, the tightening member is composed of a rotatably mounted tightening pulley, whereby in this embodiment the two support members 52 meet and merge into one which passes over the tightening pulley.

In the first step of the opening of the thermo-insulating cover 2 the winding device 55 is started briefly in the winding direction and the flexible support members 52 simultaneously lift both rotation devices 4 from their resting position to their upper position and with them the rear face 210 of the carrier segment 21 is also lifted, thereby creating a gap between the rear portion of the bearing surface 211 of the carrier segment 21 and the edge 11 of the spa vessel 1. After the rotation of the carrier segment 21 and of the carried segment 22 to the vertical position, the winding device 55 is started in the unwinding direction and the rotational device 4 along with the cover 2 are lowered to the parking position. To close the cover 2 all the steps are performed in reverse order, the last step being closing the gap between the rear portion of the bearing surface 211 of the carrier segment 21 and the edge 11.

Figure 9:
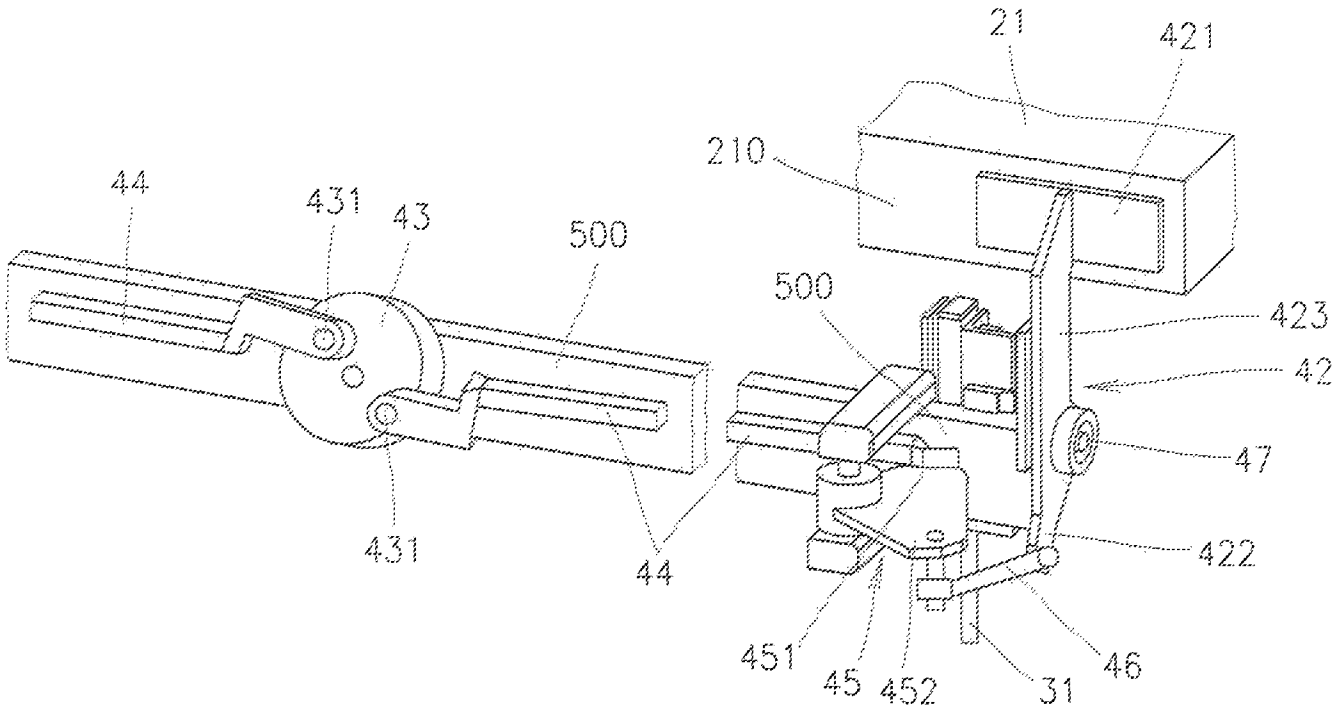
FIG. 9 represents a schematic view of one of the alternative embodiments of the rotational device of the cover.

One of the possible variants of the rotational device 4 is shown in FIG. 9. On the side struts 310 of the frame 31 of the control device is mounted, adjustably in the vertical direction, a movable beam 500, on which is mounted the rotational device 4. The movable beam 500 is part of the unillustrated device 5 for vertical manipulation with the thermo-insulating cover 2 and the rotational device 4, for example, according to any of the above or below described embodiments. On the movable beam 500 is rotatably mounted a swinging coulisse 43, on which are arranged two pins 431, on which rods 44 are rotatably mounted with one of their ends, whereby their other ends are each rotatably connected to one first arm 451 of an angular lever 45. The angular levers 45 are rotatably mounted on the opposite sides of the beam 500.

The swinging coulisse 43 is coupled to a rotary actuator 41, which may be formed, for example, by a rotary motor, or may be provided with teeth disposed about its periphery, the teeth being coupled to a rack of the linear actuator and the like.

The second arms 452 of the angular levers 45 are coupled by means of adjustable rods 46 to the first arm 422 of the rotary lever 42, which is rotatably mounted on a shaft 47 mounted on the beam 500. On the second arm 423 of the rotary lever 42 is provided a supporting plate 421, to which the carrier segment 21 is attached fixedly, for instance by means of screws. The shaft 47 is situated outside the ground plan of the spa and its axis is the axis 40 of rotation of the carrier segment 21 and, at the same time, also the axis of rotation of the rotational device 4.

In the first step of the opening of the thermo-insulating spa cover 2 the beam 500 is moved from its resting position to upper position by means of the device 5 for vertical manipulation, in which a gap is created between the rear portion of the bearing surface 210 of the carrier segment 21 and the edge 11.

In the upper position, 4 the rotary actuator, which is started by means of the rotational device, rotates the swinging coulisse 43, setting into motion the pins 431 with the rods 44 mounted on them. The rods 44 turn the angular levers 45 on both sides of the rotational device 4 and via the adjustable rod 46 start to rotate the two-armed rotary lever 42, which rotates the carried segment 21, which is fixedly attached to it and which carries the carried segment 22 until both segments 21, 22 reach the vertical position. Subsequently, the device 5 for vertical manipulation is started and the rotational device 4 along with the opened cover 2 are lowered to the parking position next to the spa vessel 1.

When closing the thermo-insulating cover 2, the procedure is opposite.

Figure 10:
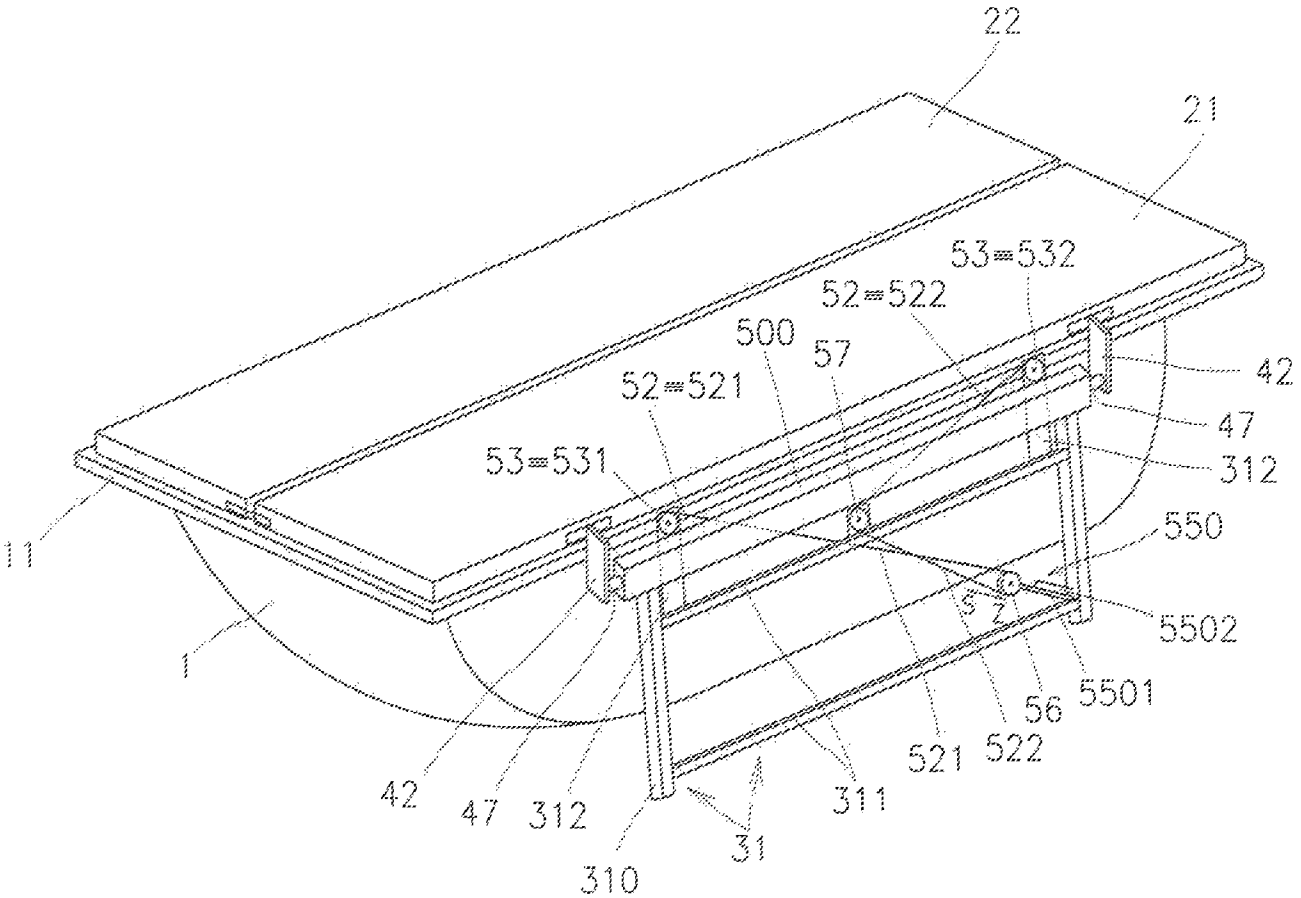
FIG. 10 is a view of another variant of the device for vertical manipulation.

FIG. 10 shows another variant of the device 5 for vertical manipulation with the cover 2 and the rotational device 4, which is suitable especially when combined with the rotational device 4 according to FIG. 9. However, FIG. 10 shows a movable beam 500 from FIG. 9, which is mounted adjustable only vertically, on which are arranged parts of the rotational device according to FIG. 9 and a shaft 47, about which rotates the rotary lever 42 with the carried segment 21 of the cover 2. The other parts of the rotational device 4 have been omitted for the sake of clearer representation and better understanding of this embodiment of the device 5 for vertical manipulation.

The movable beam 500 is hinged at two points of the flexible support member 52, which is from the points of the hinge guided upwards from the movable beam 500 over the carrying pulleys 53, which are rotatably mounted on the frame 31 of the control device above the upper position of the movable beam 500. The first branch 521 of the flexible support member 52 is guided from the first carrying pulley 531 to the tightening member 56, which is wrapped by it and afterwards the first branch becomes a second branch 522 which is guided from the tightening member 56 over the auxiliary pulley 57 to the second carrying pulley 532, which is wrapped by it and the second branch is terminated in the hinge on the movable beam 500. The tightening member 56 is mounted on the movable portion 5501 of the linear actuator 550 constituting the lifting and lowering actuator of the device 5 for vertical manipulation. In an unillustrated embodiment, the tightening member 56 is composed of a rotatably mounted tightening pulley. The fixed portion 5502 of the linear actuator 550 is mounted on the frame 31 of the control device, in an embodiment shown in FIG. 10 in the right-hand bottom corner of the frame 31. The linear actuator 550 is coupled to an unillustrated control unit along with the other members of the control device and is composed of any suitable type of a linear actuator.

The carrying pulleys 53 are mounted on the frame 31 of the control device in any other suitable manner which ensures their unchanging position and sufficient bearing capacity in the illustrated embodiment on the shims 312, which are fastened to the frame crossbeam 311 or may be mounted on an auxiliary crossbeam 31 of the frame arranged in the upper part of the frame 31.

In the first step of opening, the linear actuator 550 is started briefly in the lifting direction Z and its movable portion 5501 starts to shift from its resting position into its retracted position. Consequently, also the tightening member 56 is moved in the same manner, pulling the flexible support member 52, thereby raising the movable beam 500 to its upper position, which results in raising the rotational device 4 and the rear face 210 of the carrier segment 21 into their upper positions. Thus, a gap is formed between the rear portion of the bearing surface 211 of the carrier segment 21 and the edge 11 of the spa vessel 1. In this position, the rotational device 4 begins to rotate and after the carrier segment 21 along with the carried segment 22 are turned into the vertical position, the linear actuator 550 is started in the lowering direction S and its movable portion 5501 with the tightening member 56 begins to extend, by which means the flexible support member 52 is released and the movable beam 500, which is hinged on it, starts to lower to the parking position along with the rotational device 4 and the cover 2.

When closing the thermo-insulating cover 2, the procedure is opposite.

Both the method and the device according to the invention are intended for automation of the opening and closing of thermo-insulating covers, especially of large swim spas, providing maximum comfort to the user of the swim spa when operating the spa and allowing unrestricted view from the spa after displacement of the spa cover into parking position.

The invention claimed is:

1. A method for manipulation of a cover relative to a spa vessel of a spa or swim spa between a closed position, an open position and a parking position, whereby the cover has a first carrier segment coupled to an actuator and a second carried segment rotatably connected to the first carrier segment, the method comprising:

for manipulation of the cover from the closed position to the open position, raising an axis of rotation of the first carrier segment from a resting position to an upper position above a level of the resting position, thereby raising a rear portion of the first carrier segment and creating a gap between a lower bearing surface at the rear portion of the first carrier segment and an edge of the spa vessel while maintaining the lower bearing surface of a front portion of the first carrier segment and a lower bearing surface of the second carried segment in contact with the edge of the spa vessel;

subsequently rotating the first carrier segment about the axis of rotation with a rotation device, wherein the axis of rotation is situated outside of a ground plan of the spa or swim spa, the second carried segment being pulled towards the first carrier segment as the first carrier segment is rotated; and rotating the first carrier segment to the open position wherein the first carrier segment and the second carried segment are in a vertical position with lower bearing surfaces thereof facing each other.

2. The method according to claim 1, wherein after reaching the vertical position, the first carrier segment, the second carried segment, and the rotation device are lowered to their parking position.

3. The method according to claim 2, wherein for subsequently closing the cover, the method further comprises moving the first carrier segment, the second carried segment, and the rotation device vertically from the parking position until the axis of rotation of the carrier segment is at the upper position above the level of the resting position, then rotating the first carrier segment until the front portion of the first carrier segment abuts the edge of the spa vessel and subsequently moving the axis of rotation of the first carrier segment to the resting position such that the first carrier segment and the second carried segment are against the edge of the spa vessel.

4. The method according to claim 1, wherein the axis of rotation of the first carrier segment is raised by a device for vertical manipulation that also serves to vertically move the first carrier segment and the second carried segment between the open position and the parking position.

5. A system for automatic manipulation of a cover of a spa or swim spa between a closed position, an open position, and a parking position, the system comprising:

a cover having a first carrier segment and a second carried segment rotatably connected to the first carrier segment;

a rotational device fixedly attached to the first carrier segment to rotate the first carrier segment between a closed position and an open position wherein the first carrier segment and the second carried segment are in a vertical position; and a device for vertical manipulation of the first carrier segment and the second carried segment between the open position and the parking position connected to the first carrier segment; and the rotational device connected to the device for vertical manipulation in manner such that, for manipulation of the cover from the closed position to the open position, the first carrier segment and the rotational device are first raised such that an axis of rotation of the rotational device is raised from a resting position relative to a spa vessel to an upper position above a level of the resting position, thereby raising a rear portion of the first carrier segment and creating a gap between a lower bearing surface of the rear portion of the first carrier segment and an edge of the spa vessel while maintaining the lower bearing surface of a front portion of the first carrier segment and a lower bearing surface of the second carried segment in contact with the edge of the spa vessel.

6. The system according to claim 5, wherein the rotational device comprises a pair of rotary actuators mounted on the device for vertical manipulation, and the device for vertical manipulation is supported by a frame of a control device.

7. The system according to claim 6, wherein the device for vertical manipulation comprises flexible support members guided upwards over pulleys mounted on the frame above the upper position of the rotary actuators, the flexible support members connected at one end to the rotary actuators and at an opposite end to a lifting and lowering actuator.

8. The system according to claim 7, wherein the lifting and lowering actuator comprises one of a rotary winding device or a linear actuator.

9. The system according to claim 5, wherein the device for vertical manipulation comprises a beam movable in a vertical direction on a frame, the rotational device comprising a swinging coulisse mounted on the movable beam, the swinging coulisse comprising rotatably mounted rods connected to angular levers rotatably arranged at ends of the movable beam, each angular lever connected to a rotary lever, and each rotary lever fixed to a rear portion of the first carrier segment.

10. The system according to claim 9, wherein the movable beam is connected to flexible support members guided upwards over pulleys mounted on the frame above the upper position of the rotational device, the flexible support members connected at one end to the rotational device and at an opposite end to a lifting and lowering actuator.

11. The system according to claim 10, wherein the lifting and lowering actuator comprises one of a rotary winding device or a linear actuator.

12. The device according to claim 5, wherein the device for vertical manipulation comprises a beam movable in a vertical direction on a frame, the movable beam connected to a flexible support member guided upwards over pulleys mounted on the frame above the upper position of the rotational device, the flexible support member comprising two branches, wherein a first branch is guided from a first one of the pulleys to a tightening member mounted on the frame, the first branch wrapping around the tightening member and becoming a second branch that is guided from the tightening member over an auxiliary pulley to a second one of the pulleys, the tightening member comprising a rotary winding device or linear actuator component of the device for vertical manipulation.

13. The device according to claim 12, wherein the rotary winding device or linear actuator is arranged in a bottom corner of the frame.

* * * * *